US008511752B2

(12) United States Patent
Grove

(10) Patent No.: US 8,511,752 B2
(45) Date of Patent: Aug. 20, 2013

(54) NO-TOOLS CHAIR ASSEMBLY

(76) Inventor: James E. Grove, Marina Del Rey, CA (US)

( * ) Notice: Subject to any disclaimer, the term of this patent is extended or adjusted under 35 U.S.C. 154(b) by 621 days.

(21) Appl. No.: 12/660,834

(22) Filed: Mar. 5, 2010

(65) Prior Publication Data

US 2011/0215630 A1 Sep. 8, 2011

(51) Int. Cl.
*A47C 7/00* (2006.01)

(52) U.S. Cl.
USPC ..... 297/440.1; 297/440.16; 297/440.23

(58) Field of Classification Search
USPC ..... 297/440.1, 440.16, 440.23
See application file for complete search history.

(56) References Cited

U.S. PATENT DOCUMENTS 6,241,317 B1 * 6/2001 Wu ..... 297/440.23 X
7,188,908 B2 * 3/2007 White et al. ..... 297/440.14
7,252,339 B2 * 8/2007 Owens ..... 297/440.1
7,300,111 B2 * 11/2007 Huang ..... 297/440.16
7,306,290 B2 * 12/2007 Wiecek ..... 297/440.16 X

* cited by examiner

*Primary Examiner* — Anthony D Barfield
(74) *Attorney, Agent, or Firm* — Morland C. Fischer

(57) ABSTRACT

A chair assembly including a seat, a back and at least one arm that are detachably connected together without requiring the use of tools or special skill. The chair assembly can be advantageously shipped disassembled in a compact, space-efficient package to reduce shipping costs. An arm connection bracket affixed to the arm is slidably and removably received by an arm bracket receiver affixed to the seat, whereby the arm is detachably connected to the seat. A back connection bracket affixed to the back is slidably and removably received by a back bracket receiver affixed to the arm, whereby the back is detachably connected to the arm. The back bracket receiver includes a rotatable lock release lever that is adapted to rotate into and out of locking engagement with the back connection bracket after the back connection bracket slides into removable receipt by the back bracket receiver.

10 Claims, 3 Drawing Sheets

NO-TOOLS CHAIR ASSEMBLY

BACKGROUND OF THE INVENTION

1. Field of the Invention

This invention relates to a chair assembly including a seat, a back and a pair of arms that can all be detachably connected together without requiring the use of tools, hardware or special skill. The chair assembly can be advantageously shipped disassembled in a compact, space-efficient package so as to reduce shipping costs.

2. Background Art

Articles of furniture have long been shipped in a fully-assembled condition from a manufacturer to a retailer and then carried off by an end user to a home or office. Consequently, such an article of furniture is characteristically bulky, cumbersome and difficult to transport in a space-efficient manner. That is to say, a fully-assembled article of furniture consumes relatively large shipping space during transport by boat, truck, etc. to a retailer. Similarly, the purchaser/end user may need to have available a specially-sized vehicle should he wish to carry a large article of furniture to his home or office. The inefficient shipment of large articles of furniture between the manufacturer and end user often results in inconvenience as well as significantly higher transportation costs which are commonly passed through to the purchaser.

To overcome the aforementioned disadvantages, it is known to ship articles of furniture disassembled. In this case, the end user is typically required to have available and be able to use at least some hand tools and hardware provided by the manufacturer in order to complete the furniture assembly. Sometimes, the user may not have the skill required to use the tools and manipulate the hardware which may consequently hinder the user's ability to easily assemble and immediately enjoy his furniture. In other cases, the user may lack time and become frustrated which can result in his failure to complete the assembly altogether. Thus, the article of furniture may remain disassembled and eventually have to be returned to its point of purchase.

Accordingly, it would be desirable to have a particular article of furniture (e.g., a home or office chair) that is adapted to be shipped and transported disassembled within a compact shipping container so as to minimize shipping costs and then be relatively quickly and easily assembled without requiring special skill or the use of tools or hardware.

SUMMARY OF THE INVENTION

In general terms, the seat, back and one arm of a home or office chair assembly are described which can be detachably connected together without requiring the use of tools, hardware or special skill. The chair assembly can be shipped disassembled in a compact, space-efficient package to reduce shipping costs.

An arm bracket receiver is connected below the seat at each side thereof. The arm bracket receiver includes a flat plate having a receiving channel located at each side. An arm connection bracket is connected to the arm. The arm connection bracket includes a back plate affixed to the arm and a front plate that is aligned perpendicular with and projects from the back plate.

A back bracket receiver is connected to the arm. The back bracket receiver includes a channel that runs longitudinally along one side of the arm. A flexible lock release lever is pivotally coupled to the channel of the back bracket receiver so as to be rotatable between locked and unlocked positions.

The lock release lever has a locking catch at one end and a pair of locking legs at the opposite end.

A back connection bracket is connected behind the back at each side thereof. The back connection bracket includes a back plate that is affixed to the chair back and a front plate that is aligned perpendicular with and projects from the front plate. The back connection bracket also includes a sliding back bracket rail. The sliding back bracket rail has a leg affixed to the front plate of the back connection bracket and a base with a locking notch formed therein.

The seat, back and arm of the chair assembly are detachably connected to one another by first attaching the arm to the seat. To this end, the arm is pushed towards one side of the seat so that the sliding front plate of the arm connection bracket that is connected to the arm is moved underneath the seat and into engagement with the arm bracket receiver that is connected below the seat. In particular, the sliding front plate of the arm connection bracket slides through and is captured by the receiving channels of the arm bracket receiver. Next, the back is held above and pushed downwardly towards the arm so that the sliding back bracket rail of the back connection bracket that is connected to the back is moved into engagement with the channel of the back bracket receiver that is connected to the arm. In particular, the base of the sliding back bracket rail slides through the channel, and the locking catch of the flexible lock release lever of the back bracket receiver is rotated to the locked position and into receipt by the locking notch formed in the base of the sliding back bracket rail.

DESCRIPTION OF THE PREFERRED EMBODIMENT

Figure 1:
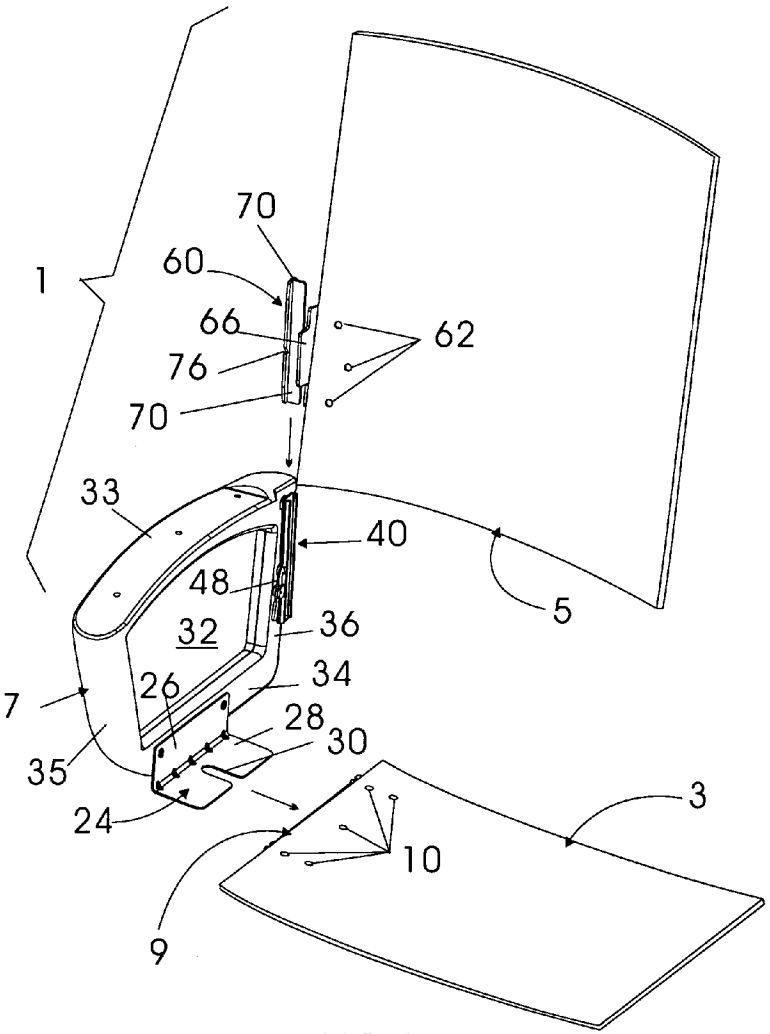
FIG. 1 is an exploded view showing the interconnection of a seat, a back and one arm of a no-tools chair assembly according to a preferred embodiment of this invention.

A preferred embodiment for a no-tools chair assembly 1 is described while referring concurrently to FIGS. 1-6 of the drawings. By virtue of the foregoing, in order to reduce shipping costs, a home or office chair may be packaged and shipped disassembled in a compact, space-efficient container. Once it is removed from its shipping container, the chair may be relatively quickly and easily assembled by the purchaser without requiring the use of tools, hardware or special skill.

The chair assembly 1 includes a seat 3, a back 5 and a pair of arms (only one of which 7 being shown and described). The seat 3, back 5 and arm 7 are packaged and shipped disassembled to be detachably interconnected to one another by the user to assemble a home or office chair. The seat 3 of chair assembly 1 is preferably manufactured from plywood, although the precise material is not to be considered a limitation of this invention. An arm bracket receiver 9 (best shown in FIGS. 2 and 5) is affixed by means of suitable fasteners (e.g., bolts) 10 to the bottom of seat 3 at each side thereof. Inasmuch as only one arm 7 of the pair of arms of the chair assembly 1 is illustrated, only a single arm bracket receiver 9 is shown and described herein.

Figure 5:
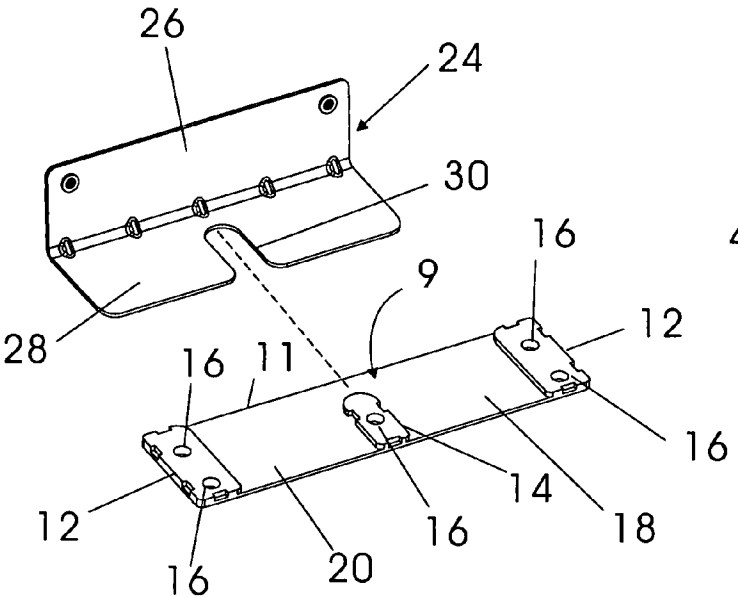
FIG. 5 is an exploded view showing the arm connection bracket of the arm to be connected to the arm bracket receiver of the seat.

The arm bracket receiver 9 is preferably a flat rectangular plate 11 that is manufactured from stamped steel or the like. A receiving channel 12 is affixed (e.g., welded) to each side of the plate 11 of arm bracket receiver 9. A guide rail 14 is affixed (e.g., welded) to the plate 11 of arm bracket receiver 9 so as to lie between the opposing receiving channels 12. Holes 16 are formed through the receiving channels 12 and the guide rail 14 therebetween to receive respective ones of the fasteners (i.e., bolts) 10 so that the arm bracket receiver 9 is connected by the manufacturer below one side of the seat 3 of chair assembly 1. As is best shown in FIG. 5, a first slide path 18 is created between the guide rail 14 and one receiving channel 12 of the arm bracket receiver 9, and a second slide path 20 is created between the guide rail 14 and the other receiving channel 12.

Figure 2:
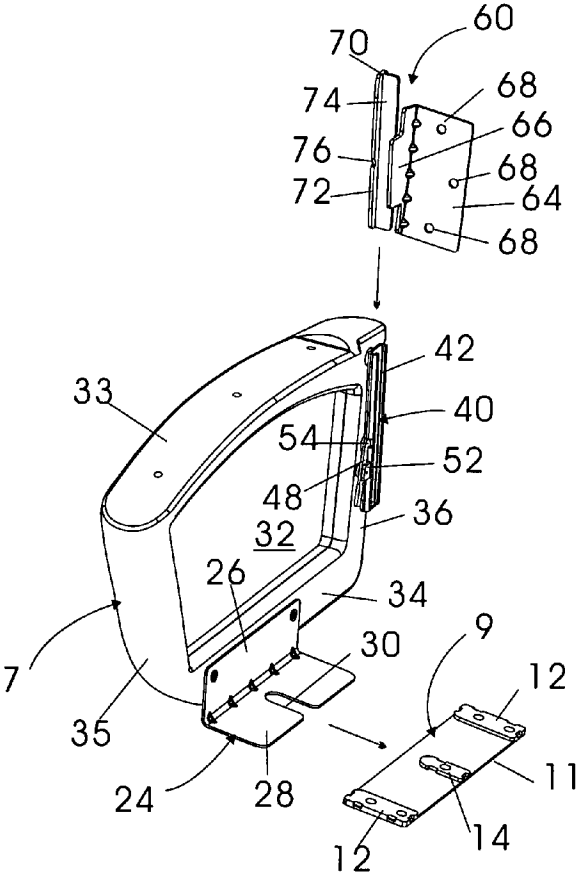
FIG. 2 is an exploded view showing the arm of the no-tools chair assembly of FIG. 1 with an arm connection bracket affixed to the arm to be connected to an arm bracket receiver and a back bracket receiver affixed to the arm to be connected to a back connection bracket.
Figure 4:
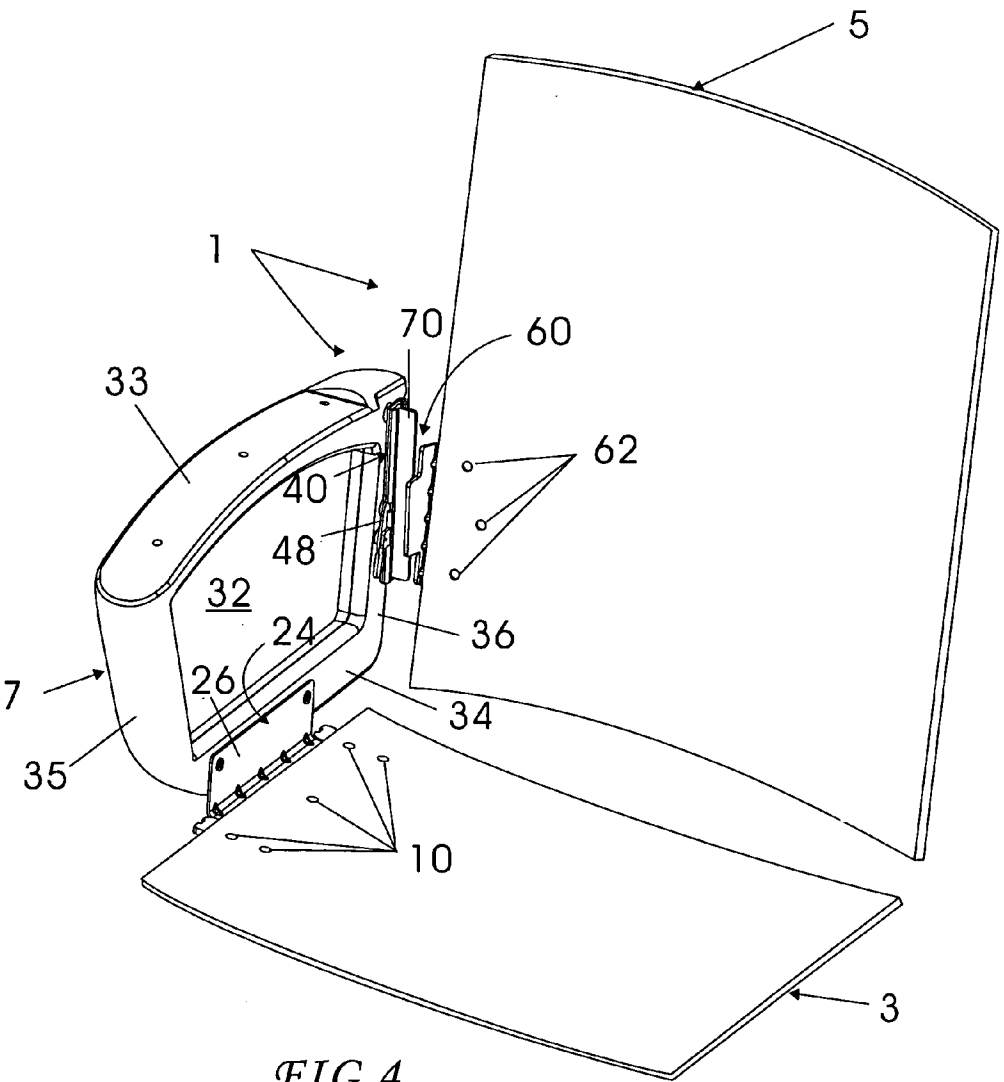
FIG. 4 shows the seat, back and arm of the no-tools chair assembly of FIG. 1 interconnected to one another.
Figure 3:
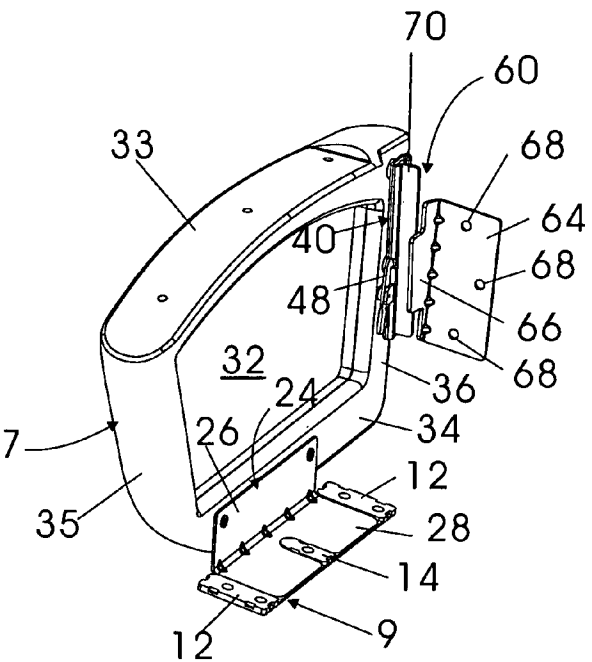
FIG. 3 shows the arm of the no-tools chair assembly with the arm connection bracket thereof connected to the arm bracket receiver and the back bracket receiver thereof connected to the back connection bracket.

An arm connection bracket 24 is affixed to the arm 7 of the chair assembly 1 to enable a no-tools attachment by the user of arm 7 to the arm bracket receiver 9 connected below one side of the seat 3. The arm connection bracket 24 is preferably manufactured from stamped steel, or the like, and as is best shown in FIGS. 2 and 5, includes a flat back plate 26 and a flat sliding front plate 28. The back and front plates 26 and 28 of arm connection bracket 24 are aligned perpendicular to one another. As is best shown in FIGS. 1 and 2, the back plate 26 of bracket 24 is affixed to the inside of the arm 7 of chair assembly 1 such that the sliding front plate 28 of bracket 24 projects from the arm 7. A positioning slot 30 is formed in the sliding front plate 28 so as to run parallel to and midway between the opposite sides thereof.

The chair arm 7 to which the back plate 26 of the arm connection bracket 24 is affixed may be manufactured from any one of a variety of materials (e.g., molded plastic, wood, etc.) and may have any one of a variety of shapes to enhance the ornamentality of the chair assembly 1. In the example shown in FIGS. 1-4, the arm 7 includes a see-through central window 32 that is surrounded by a frame having a top 33, a bottom 34, and a pair of sides 35 and 36. An arm pad (not shown) may be connected within a recess at the top 33 of the frame of arm 7 to maximize the comfort of the user. The arm connection bracket 24 is affixed to the bottom 34 of arm 7 so that the sliding front plate 28 of bracket 24 stands outwardly from the arm 7 to be aligned by the user for receipt by the arm bracket receiver 9 that is connected below the seat 3 in a manner that will soon be described.

Figure 6:
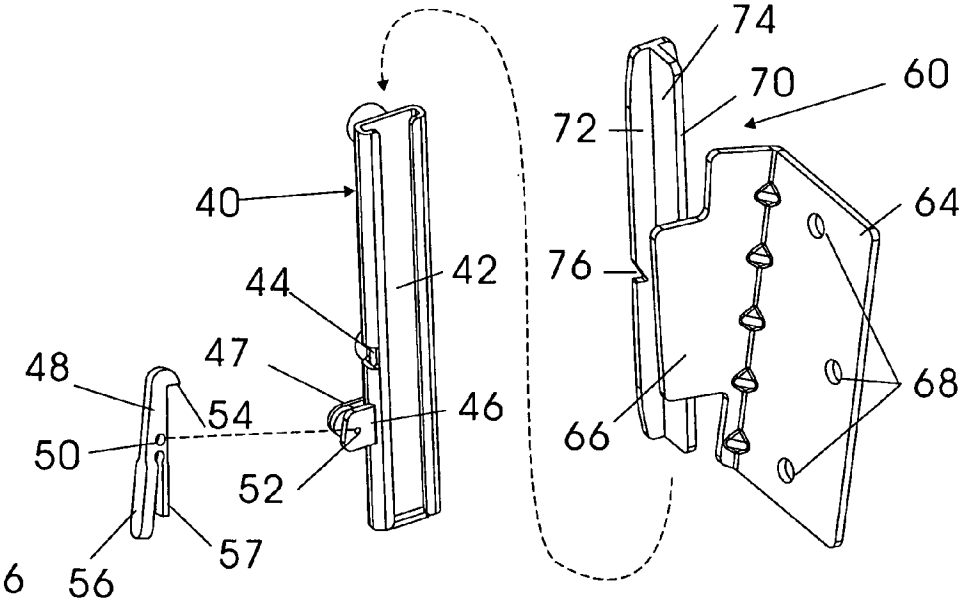
FIG. 6 is an exploded view showing the back connection bracket of the back to be connected to the back bracket receiver of the arm.

A back bracket receiver 40 is affixed to the chair arm 7 at one side 36 of the frame thereof. As is best shown in FIG. 6, the back bracket receiver 40 includes an elongated channel 42 that runs generally vertically along the side 36 of the arm 7 to which receiver 40 is affixed. A lock access opening 44 is formed in the back bracket receiver 40 so as to communicate with the channel 42. Located below the lock access opening 44 and carried by the channel 42 of receiver 40 is a lock carrying tab 46. A lock support 47 is also carried by channel 42 so as to be spaced from and located behind the lock carrying tab 46. A lock release lever 48 is pivotally coupled to the back bracket receiver 40 so as to be rotatable by the user between locked and unlocked positions. That is, the lock release lever 48 is positioned in the space between the lock carrying tab 46 and the lock support 47. A coupling hole 50 is formed through the lock release lever 48, and a pivot (e.g., a pin, a rivet, or the like) 52 is attached between the lock carrying tab 46 and the lock support 47 by way of the coupling hole 50 through the lock release lever 48.

The lock release lever 48 has a locking catch 54 at one end thereof and a pair of locking legs 56 and 57 located at the opposite end so as to be angled relative to and spaced apart from one another. It is preferable that the lock release lever 48 is manufactured from a flexible (e.g., plastic) material. Therefore, the spaced locking legs 56 and 57 of lock release lever 48 can be pushed (i.e., bent) towards one another in response to a compressive force applied thereto by the user for a purpose that will be explained in greater detail hereinafter.

A back connection bracket 60 is affixed by means of suitable fasteners (e.g., bolts) 62 behind one side of the back 5 of the chair assembly 1. The back connection bracket 60 is preferably manufactured from stamped steel, or the like, and, as is best shown in FIG. 6, includes a flat back plate 64 and a flat front plate 66. The back and front plates 64 and 66 of back connection bracket 60 are aligned perpendicular to one another. As is best shown in FIGS. 1 and 2, the back plate 64 of bracket 60 is affixed by fasteners 62 to the rear of the back 5 of assembly 1 such that the front plate 66 projects from the back plate 64 so as to lie in front of the back 5. Holes 68 are formed through the front plate 64 to receive the fasteners 62 by which the back connection bracket 60 is affixed to the back 5 of chair assembly 1 as just described.

A generally T-shaped sliding back bracket rail 70 of the back connection bracket 60 is affixed (e.g., welded) to the front plate 66 thereof. The back bracket rail 70 includes a flat base 72 and a perpendicularly-aligned leg 74 projecting from the base 72. As best shown in FIG. 6, the leg 74 of rail 70 is joined to the front plate 66 of back connection bracket 60 such that the base 72 of rail 70 is spaced from each of the front and back plates 64 and 66. A locking notch 76 is formed in one side of the base 72 of bracket 60. In the as-manufactured configuration of FIG. 1 with the back connection bracket 60 connected to the rear of the back 5 of chair assembly 1, the sliding back bracket rail 70 is held outwardly from one side of the chair back 5 to be detachably connected by the user to the back bracket receiver 40 that is connected to the chair arm 7.

The detachable interconnection by the user of the seat 3, back 5 and arm 7 of chair assembly 1 without the use of tools or special skill will now be described while continuing to refer to FIGS. 1-6. The chair arm 7 is initially mated to one side of the chair seat 3 when the arm connection bracket 24 that is connected to arm 7 is removably received by the arm bracket receiver 9 that is connected below the seat 3. More particularly, the arm 7 is pushed towards the seat 3 so that the sliding front plate 28 of bracket 24 moves underneath the seat 3 and slides over the plate 11 and along the first and second slide paths 18 and 20 of receiver 9. In this case, the sliding front plate 28 rides through and is captured by the receiving channels 12 at the sides of receiver 9 so that the guide rail 14 of receiver 9 is located within the positioning slot 30 of bracket 24. With the back plate 26 of arm connection bracket 24 connected to the chair arm 7 and the sliding front plate 28 of bracket 24 moved through and into engagement with the receiving channels 12 of the arm bracket receiver 9, the chair arm 7 of chair assembly 1 will be held in place against one side of the seat 3. Moreover, the receipt of the sliding front plate 28 by the arm bracket receiver 9 below the seat 3 prevents the arm 7 from twisting or tuning relative to the seat.

The no-tools chair assembly 1 of FIGS. 1-6 is further completed when the chair back 5 is mated to the chair arm 7 by the user pushing the back connection bracket 60 that is connected to one side of back 5 into removable receipt by the back bracket receiver 40 that is connected to arm 7. More particularly, the back 5 is lifted above the arm 7, and the back connection bracket 60 is moved downwardly towards the back bracket receiver 40 until the base 72 of the sliding back bracket rail 70 of bracket 60 slides through and into mating engagement with the channel 42 of receiver 40 (in the direction of the reference arrow of FIGS. 1 and 2). When the back bracket rail 70 is mated to the channel 42, the locking notch 76 formed in the base 72 of rail 70 will be positioned adjacent and aligned with the lock access opening 44 of the receiver 40 that communicates with the channel 42.

The lock release lever 48 which is pivotally coupled between the lock carrying tab 46 and the lock support 47 of the back bracket receiver 40 is automatically rotated around pivot 52 in a clockwise direction to the locked position. That is, and as best illustrated when referring to FIGS. 1 and 4, one of the locking legs 57 of the pair of angled legs 56 and 57 of lock release lever 48 lies adjacent and is pushed against the channel 42 such that the locking catch 54 of lever 48 is urged (i.e., rotated) through the lock access opening 44 so as to snap into locking engagement with the locking notch 76 that is formed in base 72 of the back bracket rail 70. When the locking catch 54 of lock release lever 48 is moved into receipt of and captured by the locking notch 76 of rail 70, the back connection bracket 60 is detachably connected to the back bracket receiver 40, such that one side of the chair back 5 is correspondingly detachably connected to the chair arm 7 to prevent the chair arm 7 from being pulled away from the seat 3. The engagement of the locking catch 54 by the locking notch 76 also prevents the base 72 of rail 70 from sliding upwardly and out of the channel 42 of the back bracket receiver 40. It may therefore be appreciated that with the back connection bracket 60 slidably received by the back bracket receiver 40 and the locking catch 54 captured by the locking notch 76, the seat 3, back 5 and arm 7 of the chair assembly 1 are all interconnected to one another so as to avoid an inadvertent separation thereof.

Should it become necessary to disconnect the chair back 5 from the chair arm 7 of the chair assembly 1, the user applies a pushing or compressive force against the locking leg 56 of the pair of angled legs 56 and 57 of lock release lever 48. Because of the flexible nature of lock release lever 48, the locking leg 56 (of FIG. 6) moves towards the locking leg 57 lying against the channel 42 to cause lever 48 to rotate around pivot 52 in an opposite counter-clockwise direction to the unlocked position. In this case, the locking catch 54 of lever 48 will be moved out of its locking engagement with the locking notch 76 formed in base 72 of the sliding back bracket rail 70. The sliding back bracket rail 70 of the back connection bracket 60 can now be pulled upwardly so as to slide outwardly from the channel 42 of the back bracket receiver 40. Accordingly, the back connection bracket 60 is separated from the back bracket receiver 40, whereby the one side of the chair back 5 to which bracket 60 is affixed is disconnected from the chair arm 7.

Once the pushing (i.e., compressive) force is removed from the lock release lever 48, the angled locking legs 56 and 57 thereof will automatically move apart so that the locking catch 54 is again biased to snap into locking engagement within the locking notch 76 formed in the base 72 of the sliding back bracket rail 70 whenever the base 72 of the rail 70 of the back connection bracket 60 is pushed into and through the channel 42 of back bracket receiver 40. Therefore, it may be appreciated that the flexible lock release lever 48 has a spring memory such that the locking legs 56 and 57 are adapted to be pushed towards one another and compressed and then separate and expand as lever 48 rotates around pivot 52 first from the locked position to the unlocked position and then from the unlocked position back to the locked position.

When the chair back 5 is separated from the chair arm 7 as just explained, should it become necessary, the arm 7 may be detached from the seat 3 by the user pulling the arm away from the seat in order to cause the arm connection bracket 24 to slide out and separate from the arm bracket receiver 9.

The no-tools chair assembly 1 shown in FIGS. 1-6 can be interfaced with other parts of a chair. For example, a seat cushion can be laid over the seat 3. The seat 3 may be coupled to a chair base with wheels to support the seat above the ground. However, such other chair parts form no part of the presently-described improvement and the selection and interconnection thereof are intended to create no limitations to the invention claimed herein.

The invention claimed is:

1. A chair assembly comprising a seat, a back, at least one arm, an arm connector carried by said one arm, an arm connector receiver carried by said seat, a back connector carried by said back, and a back connector receiver carried by said one arm, said arm connector being mated to said arm connector receiver without the use of tools and said back connector being mated to said back connector receiver without the use of tools such that said one arm is attached to said seal and said back is attached to said one arm without the use of tools, the back connector carried by said hack having a sliding rail, the back connector receiver carried by said one arm having a receiving channel, the sliding rail of said back connector being slidable into receipt by and engagement with the receiving channel of said back connector receiver, whereby said back connector is mated to said back connector receiver, said back connector receiver also having a lock to be located in releasable locking engagement with the sliding rail of said back connector when said sliding rail slides into receipt by and engagement with the receiving channel of said back connector receiver, and the sliding rail of said back connector having a locking notch formed therein and the lock of said back connector receiver having a catch, said catch moving into removable receipt by said locking notch, whereby said lock is located in said releasable locking, engagement with said sliding rail to prevent said sliding rail from sliding out of said receiving channel.

2. The chair assembly recited in claim 1, wherein said arm connector is removable from said atm connector receiver without the use of tools and said back connector is removable from said back connector receiver without the use of tools such that said one arm is detachable from said seat and said back is detachable from said one arm without the use of tools.

3. The chair assembly recited in claim 1, wherein said arm connector receiver is located at one side of said seat and said arm connector carried by said one arm is slidably received by and mated to said arm connector receiver.

4. The chair assembly recited in claim 3, wherein said arm connector carried by said one arm has a plate that projects from said arm and said arm connector receiver carried by said seat has a receiving channel, the plate of said arm connector being slidable into receipt by and engagement with the receiving channel of said arm connector receiver, whereby said arm connector is mated to said arm connector receiver.

5. The chair assembly recited in claim 1, wherein said back connector is located at one side of said back to be slidably received by and mated to said back connector receiver carried by said one arm.

6. The chair assembly recited in claim 1, wherein said back connector carried by said back also has a first plate attached to one side of said back and a second plate attached to said sliding rail, said first and second plates being aligned with one another such that said sliding rail is spaced outwardly from the one side of said back.

7. The chair assembly recited in claim 1, wherein the lock of said back connector receiver is rotatable relative to the receiving channel thereof, said lock rotating to a locked position so that the catch of said lock is correspondingly moved into said removable receipt by the locking notch of said sliding rail when said sliding rail slides into receipt by said receiving channel.

8. The chair assembly recited in claim 7, wherein said back connector receiver also has a pivot to which said lock is coupled so that said lock is rotatable relative to said receiving channel from said locked position where the catch of said lock is moved into said removable receipt by the locking notch of the sliding rail of said back connector to an unlocked position where the catch of said lock is moved out of receipt of said locking notch.

9. The chair assembly recited in claim 8, wherein the lock of said back connector receiver has said catch located at one end thereof and a pair of legs spaced from one another and located at an opposite end, one of said pair of legs contacting said receiving channel so as to urge said lock to rotate at said pivot to said locked position, and said lock rotating at said pivot to said unlocked position in response to a compressive force applied to said lock by which said legs are pushed towards one another.

10. The chair assembly recited in claim 8, wherein said look is manufactured from a flexible material such that said pair of legs have a spring memory so as to move away from one another to cause said lock to rotate from said unlocked position to said locked position when said compressive force is removed from said look.

* * * * *